US008000448B2

(12) United States Patent
Nose et al.

(10) Patent No.: US 8,000,448 B2
(45) Date of Patent: Aug. 16, 2011

(54) DEVICE AND METHOD FOR ADJUSTING COLLISION TIMING BETWEEN ELECTRON BEAM AND LASER LIGHT

(75) Inventors: Hiroyuki Nose, Tokyo (JP); Daisuke Ishida, Tokyo (JP); Namio Kaneko, Tokyo (JP); Yasuo Sakai, Tokyo (JP); Mitsuru Uesaka, Tokyo (JP); Fumito Sakamoto, Tokyo (JP); Katsuhiro Dobashi, Tokyo (JP)

(73) Assignees: IHI Corporation, Tokyo (JP); The University of Tokyo, Tokyo (JP)

( * ) Notice: Subject to any disclaimer, the term of this patent is extended or adjusted under 35 U.S.C. 154(b) by 15 days.

(21) Appl. No.: 12/667,367

(22) PCT Filed: Jul. 1, 2008

(86) PCT No.: PCT/JP2008/061905

§ 371 (c)(1),
(2), (4) Date: Dec. 30, 2009

(87) PCT Pub. No.: WO2009/005060

PCT Pub. Date: Jan. 8, 2009

(65) Prior Publication Data

US 2011/0007875 A1 Jan. 13, 2011

(30) Foreign Application Priority Data

Jul. 3, 2007 (JP) ..... 2007-175190

(51) Int. Cl.
*H05G 2/00* (2006.01)
*H01J 35/00* (2006.01)

(52) U.S. Cl. ..... 378/119; 378/121

(58) Field of Classification Search ..... 378/119, 378/121, 136, 137, 145, 143
See application file for complete search history.

(56) References Cited

U.S. PATENT DOCUMENTS 6,377,651 B1 * 4/2002 Richardson et al. ..... 378/34
6,687,333 B2 * 2/2004 Carroll et al. ..... 378/119
7,372,056 B2 * 5/2008 Bykanov et al. ..... 250/504 R
7,382,861 B2 * 6/2008 Madey et al. ..... 378/119

FOREIGN PATENT DOCUMENTS

JP 07-110400 4/1995

(Continued)

OTHER PUBLICATIONS

International Search Report, issued in corresponding application No. PCT/JP2008/061904, completed Aug. 5, 2008, mailed Aug. 19, 2008.

(Continued)

*Primary Examiner* — Irakli Kiknadze
(74) *Attorney, Agent, or Firm* — Griffin & Szipl, P.C.

(57) ABSTRACT

An electron beam detection device (34) is arranged on an electron beam passing path so that a beam delay time $t_B$ from a passing moment of an electron beam (1) to a moment when the beam reaches a predicted collision point (9*a*) is longer than a laser delay time $t_L$ from a moment when a command for generating laser light (3) is issued to the moment when the laser light reaches the predicted collision point (9*a*) by at least a predetermined delay time Δt. The device (34) may detect passing therethrough without affecting the electron beam and output a laser light generation command from a laser light command delay circuit (36) when the predetermined delay time Δt ($=t_B-t_L$) has elapsed after the detection.

5 Claims, 6 Drawing Sheets

FOREIGN PATENT DOCUMENTS

| | | | |
|---|---|---|---|
| JP | 11-142786 | | 5/1999 |
| JP | 2001-345503 | | 12/2001 |
| JP | 2002-011584 | | 1/2002 |
| JP | 3463281 | B2 | 11/2003 |
| JP | 2004-226271 | | 8/2004 |
| JP | 2004-227952 | | 8/2004 |
| JP | 2005-285764 | | 10/2005 |
| JP | 2006-318746 | | 11/2006 |
| JP | 2006-344731 | | 12/2006 |
| WO | 2006/121126 | A1 | 11/2006 |

OTHER PUBLICATIONS

Katsuhiro Dohashi et al., "Development of Small-Sized Hard X-Ray Source using X-Band Linac," 27-th Linac Technology Research Meeting, 2002, pp. 1-3.

International Search Report, issued in corresponding application No. PCT/JP2008/061905, completed Sep. 25, 2008, mailed Oct. 7, 2008.

Yasuo Suzuki et al., A New Laser Mass Spectrometry for Chemical Ultratrace Analysis Enhanced with Multi-Mirror System (RIM-MPA), Analitical Science, 2001, vol. 17 Supplement.

* cited by examiner

DEVICE AND METHOD FOR ADJUSTING COLLISION TIMING BETWEEN ELECTRON BEAM AND LASER LIGHT

This is a National Phase Application in the United States of International Patent Application No. PCT/JP2008/061905 filed Jul. 1, 2008, which claims priority on Japanese Patent Application No. 2007-175190, filed Jul. 3, 2007. The entire disclosures of the above patent applications are hereby incorporated by reference.

BACKGROUND OF THE INVENTION

1. Technical Field of the Invention

The present invention relates to a device and method for adjusting collision timing between an electron beam and laser light when an X-ray is generated by inverse Compton scattering.

2. Description of the Related Art

As means for generating an X-ray by a small-sized device, means capable of obtaining a quasi-monochromatic X-ray arisen from inverse Compton scattering by a collision between an electron beam and laser light is known (e.g., Non-Patent Document 1 and Patent Documents 1 to 3).

In "Small-Sized X-Ray Generator" of Non-Patent Document 1, as illustrated in FIG. 1, an electron beam 52 accelerated by a small-sized accelerator 51 (an X-band acceleration tube) is allowed to collide with laser 53 to generate an X-ray 54. The electron beam 52 generated by an RF (Radio Frequency) electron gun 55 (a thermal RF gun) is accelerated by the X-band acceleration tube 51, and collides with the pulse laser light 53. The hard X-ray 54 having a time width of 10 ns is generated by Compton scattering.

In this figure, reference numeral 41 denotes a power source, 42 denotes an α-magnet, 43 denotes a magnet, 44 denotes Q-magnets, 45 denotes a beam dump, 46 denotes a laser unit, 47 denotes a mirror, 48 denotes a lens, 49 denotes a laser dump, 50 denotes a synchronizer, and A denotes a collision point.

This device is miniaturized by using, as an RF, an X-band (11.424 GHz) corresponding to a frequency four times as high as that of an S-band (2.856 GHz) for general use in a linear accelerator, and it is predicted that the hard X-ray having, for example, an X-ray intensity (a photon number) of about $1\times10^9$ photons/s and a pulse width of about 10 ps will be generated.

"Method and Apparatus for Producing High Brightness X-Rays or γ-Rays" of Patent Document 1 have an object to accumulate laser light in an optical resonator having ultra-high reflectivity mirrors and use this light so that powerful high brightness X-rays or γ-rays are produced from even small initial laser.

Therefore, in this invention, as illustrated in FIG. 2, laser light from a laser 61 is injected into an optical resonator 62 and accumulated therein. The optical resonator 62 has ultra-high reflectivity mirrors 63, 64 having a mirror reflectivity of 0.999% or more. An electron beam may be introduced obliquely into the optical resonator 62 to make a collision. In the interaction area, X-rays or γ-rays 66 are produced due to Compton scattering. In this figure, reference numeral 65 denotes an accelerator.

"System and Method for X-Ray Generation" of Patent Document 2 have an object to generate X-rays via the process of inverse Compton scattering.

Therefore, as illustrated in FIG. 3, the system of this invention includes a high repetition rate laser 72 adapted to direct high-energy optical pulses 73 in a first direction 71 within a laser cavity 70 and a source 74 of a pulsed electron beam 78 adapted to direct the electron beam 78 in a second direction 76 opposite the first direction within the laser cavity 70. The electron beam 78 interacts with photons in the optical pulses 73 within the laser cavity 70 to produce X-rays 75 in the second direction 76. In this figure, reference numeral 79 denotes a pump laser.

"Multi-Color X-Ray Generator" of Patent Document 3 has an object to successively switch and generate a plurality of (two, three or more types of) monochromatic hard X-rays at short time intervals to such an extent that it may be judged that a blood vessel does not move, and generate an intense X-ray applicable to angiography or the like.

Therefore, as illustrated in FIG. 4, the device of this invention includes an electron beam generator 85 which accelerates an electron beam to generate a pulse electron beam 81 and which passes the beam through a predetermined rectilinear orbit 82, a composite laser generator 86 which successively generates a plurality of pulse laser lights 83*a*, 83*b* having different wavelengths, and a laser light introduction device 87 which introduces the plurality of pulse laser lights into the rectilinear orbit 82 to be opposed to the pulse electron beam 81, so that the plurality of pulse laser lights 83*a*, 83*b* successively head-on collides with the pulse electron beam 81 in the rectilinear orbit 82 so as to generate two or more types of monochromatic hard X-rays 84 (84*a*, 84*b*). In this figure, reference numeral 88 denotes a pump laser.

[Non-Patent Document 1]

"Development of Small-Sized Hard X-Ray Source using X-band Linac", 27-th Linac Technology Research Meeting, 2002, authored by Katsuhiro DOHASHI, et al.

[Patent Document 1]

Japanese Patent Application Laid-Open No. 7-110400 titled "Method and Apparatus for Producing High Brightness X-Rays or γ-Rays"

[Patent Document 2]

Japanese Patent Application Laid-Open No. 2005-285764 titled "System and Method for X-Ray Generation"

[Patent Document 3]

Japanese Patent Application Laid-Open No. 2006-318746 titled "Multi-Color X-Ray Generator"

As described above, there have been proposed various types of means for colliding laser light with an electron beam and generating an X-ray by inverse Compton scattering. In these conventional examples, as schematically illustrated in FIG. 9, it is assumed that a signal is sent from a synchronizer a (a master oscillator) to a high-frequency generator c and a laser unit d using a delay circuit b or the like at the proper timing and an electron beam is allowed to collide with laser light at a desired place.

FIG. 10 is a schematic diagram of a collision-timing adjusting method by a conventional synchronizer. In this figure, the horizontal axis represents the time, $t_R$ represents a time (hereinafter, referred to as "high-frequency delay time") from a high-frequency generation moment to a moment when an electron beam reaches a collision point, $t_e$ represents a time (hereinafter, referred to as "electron delay time") from an electron generation moment to the moment when the electron beam reaches the collision point, and $t_L$, represents a time (hereinafter, referred to as "laser delay time") from a laser oscillation moment to the moment when the laser light reaches the collision point.

The above-described conventional method calculates in advance the high-frequency delay time $t_R$, the electron delay time $t_e$, and the laser delay time $t_L$ from the device constitution, and presets a time $dt_e$ ($=t_R-t_e$: electron generation delay time) from the high-frequency generation moment to the electron generation moment and a time $dt_L$ ($=t_R-t_L$: laser generation delay time) from the high-frequency generation moment to the laser oscillation moment in each delay circuit b.

However, a time until the high-frequency generator c actually generates a high frequency HF after receiving a high frequency generation signal and a time until an electron generator (e.g., electron gun) actually generates an electron E after receiving an electron generation signal are not 0 in a narrow sense. According to a state of the high-frequency generator c or the electron generator (electron gun), the real generation timing may fluctuate (change). An electron immediately after generation is before acceleration by an acceleration tube, and is slightly slower than the light speed (e.g., about 90% of the speed of light).

Therefore, the above-described conventional method has a problem in that a real collision position (a real collision point) are different from a predicted collision point since times when the electron beam and the laser light reach the collision point are slightly different. As a result, an amount of X-rays generated is reduced since a collision area is reduced. On the other hand, a virtual focus (generation point) of an X-ray changes and an image captured using the focus is blurred.

FIG. 11 is a diagram schematically illustrating a collision situation between an electron beam and laser light. In this figure, reference numeral 1 denotes an electron beam, 3 denotes laser light, 4 denotes an X-ray, 8 denotes an allowed collision area, 9*a* denotes a predicted collision point, and 9*b* denotes a real collision point.

The predicted collision point 9*a* is preset on a common orbit (optical path) of the laser light 3 and the electron beam 1. The laser light 3 is pulse laser light incident from the left to the right in this example, and is concentrated at the predicted collision point 9*a* to have a minimum light-focusing diameter (e.g., 1 μm or less)

The electron beam 1 is an electron beam bunch incident from the right to the left in this example. When the electron beam 1 reaches the predicted collision point 9*a* along with the laser light 3, a collision rate between the two is maximized and a maximum amount of X-rays 4 is generated. Since the collision rate is sufficiently high before and after the predicted collision point 9*a*, for example, a range where a light-focusing area is equal to or less than twice the predicted collision point 9*a* is regarded as the allowed collision area 8. The allowed collision area 8 has, for example, a range of several 10 mm before and after the predicted collision point 9*a*.

The speed upon collision of the electron beam may reach substantially the light speed (about 300,000 km/s=$3\times10^8$ m/s in a vacuum). Therefore, even when a time in which the electron beam 1 reaches the predicted collision point 9*a* is only 1 ns ($=10^{-9}$ s) later than that of the laser light 3, a difference between the real collision point 9*b* and the predicted collision point 9*a* is ΔL (=about 300 mm). Since a deviation from the allowed collision area 8 is also large and the pulse laser light 3 is greatly spread out as compared with the minimum light-focusing diameter, the collision rate is very lowered (substantially close to 0) and the above-described problem occurs.

The present invention has been made to solve the above-described problem. That is, an object of the present invention is to provide a device and method for adjusting collision timing between an electron beam and laser light, which may precisely position a real collision point between the electron beam and the laser light at a predicted collision point or the neighborhood thereof even when the timing of generating an electron or an electron beam fluctuates (changes), thereby increasing a collision rate between the two to increase an X-ray generation output and preventing a virtual focus (generation point) of an X-ray from being changed to increase a resolution of an image captured using the X-ray.

SUMMARY OF THE INVENTION

According to the present invention, there is provided a device for adjusting collision timing between an electron beam and laser light in an X-ray generator which generates an X-ray by inverse Compton scattering by colliding the electron beam with the laser light, the device comprising:

an electron beam detector arranged on a passing path of an electron beam, which detects passing therethrough without affecting the electron beam; and a laser light command delay circuit which outputs a laser light generation command when a predetermined delay time has elapsed after detecting the passing of the electron beam, wherein an installation position of the electron beam detector is set so that a beam delay time from an electron beam passing moment to a moment when the electron beam reaches a predicted collision point is longer than a laser delay time from a moment when the laser light generation command is issued to a moment when the laser light reaches the predicted collision point by at least the delay time.

According to a preferred embodiment of the present invention, the electron beam detector has a conductive coil that is provided on an outer side of a duct through which the electron beam is passed and surrounds an electron beam path and a current detector that measures an induced current occurring in the coil.

A laser generator which generates the laser light is a Q-switched pulse laser and adjusts timing of a Q-switch by detection of the current detector.

According to the present invention, there is provided a method for adjusting collision timing between an electron beam and laser light in an X-ray generator which generates an X-ray by inverse Compton scattering by colliding the electron beam with the laser light, the method comprising:

setting an installation position on a passing path of an electron beam so that a beam delay time from an electron beam passing moment to a moment when the electron beam reaches a predicted collision point is longer than a laser delay time from a moment when a laser light generation command is issued to a moment when the laser light reaches the predicted collision point by at least a predetermined delay time;

detecting passing of the electron beam at the set position without affecting the electron beam; and outputting the laser light generation command when the predetermined delay time has elapsed after detecting the passing of the electron beam.

According to a preferred embodiment of the present invention, a conductive coil surrounding an electron beam path is provided on an outer side of a duct through which the electron beam is passed, and the passing of the electron beam is detected by measuring an induced current occurring in the coil without affecting the electron beam.

According to the device and method of the present invention described above, the installation position of the electron beam detector is set on the electron beam passing path so that the beam delay time $t_B$ from the electron beam passing moment to the moment when the electron beam reaches the predicted collision point is longer than the laser delay time $t_L$ from the moment when the laser light generation command is issued to the moment when the laser light reaches the predicted collision point by at least the predetermined delay time.

The predetermined delay time Δt may be variably adjusted by a delay circuit at a high precision of 0.1 ns or less.

According to a state of the high-frequency generator or electron generator (electron gun), the beam delay time $t_B$, the laser delay time $t_L$, and the difference (delay time) Δt therebetween may be produced in advance with high precision substantially without a change even when the timing of generating an electron or an electron beam fluctuates (changes).

By detecting the passing of the electron beam at the position set on the electron beam passing path without affecting the electron beam and by outputting the laser light generation command when the predetermined delay time has elapsed after the detection, the fluctuation (change) of the beam delay time from the moment when the electron beam is passed through the detection position to the moment when the electron beam reaches the predicted collision point may be minimized even in the case where the timing of generating an electron or an electron beam to the generation command changes. As a result, since a collision section area of the electron beam and the laser light may be substantially uniform, the temporal fluctuation in the intensity of generated X-rays may be minimized, and good reproducibility may be expected. Since a virtual focus of an X-ray does not change, an X-ray image may be captured with higher precision.

DESCRIPTION OF THE PREFERRED EMBODIMENT

Figure 1:
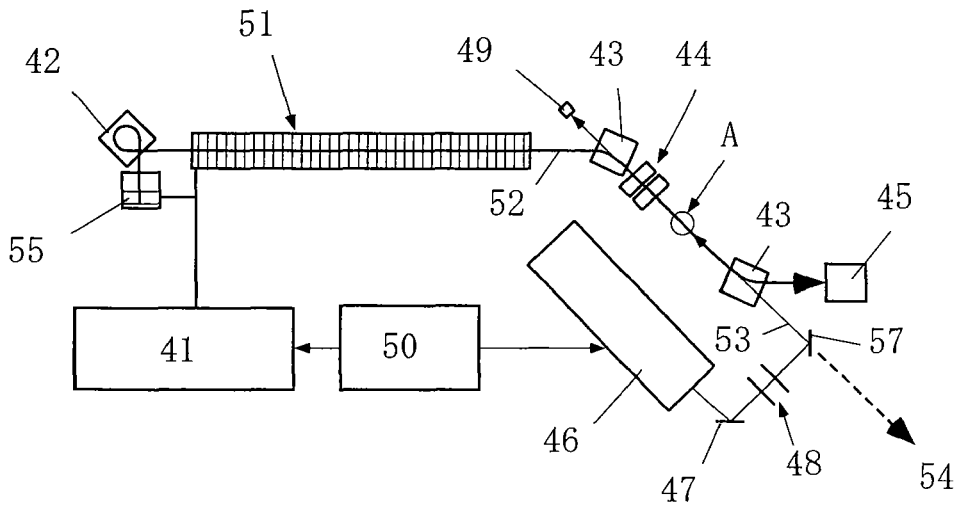
Fig. 1 Prior Art
FIG. 1 is a constitution diagram of "Small-sized X-Ray Generator" of Non-Patent Document 1.
Figure 2:
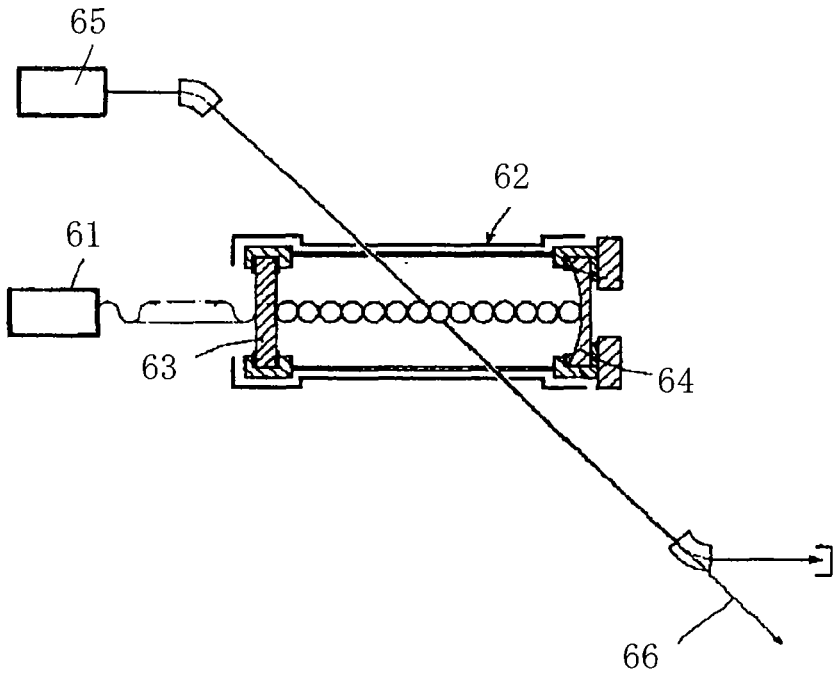
Fig. 2 Prior Art
FIG. 2 is a constitution diagram of "Method and Apparatus for Producing High Brightness X-Rays or γ-Rays" of Patent Document 1.
Figure 3:
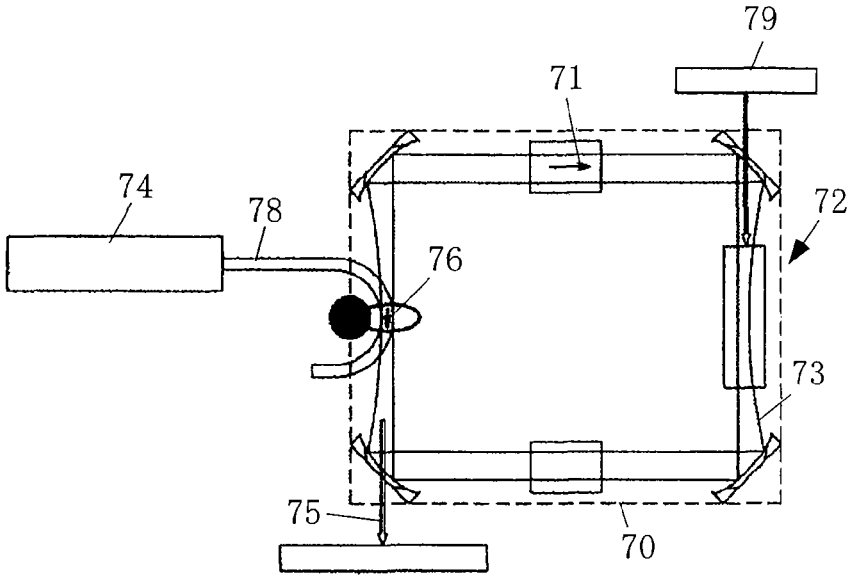
Fig. 3 Prior Art
FIG. 3 is a constitution diagram of "System and Method for X-Ray Generation" of Patent Document 2.
Figure 4:
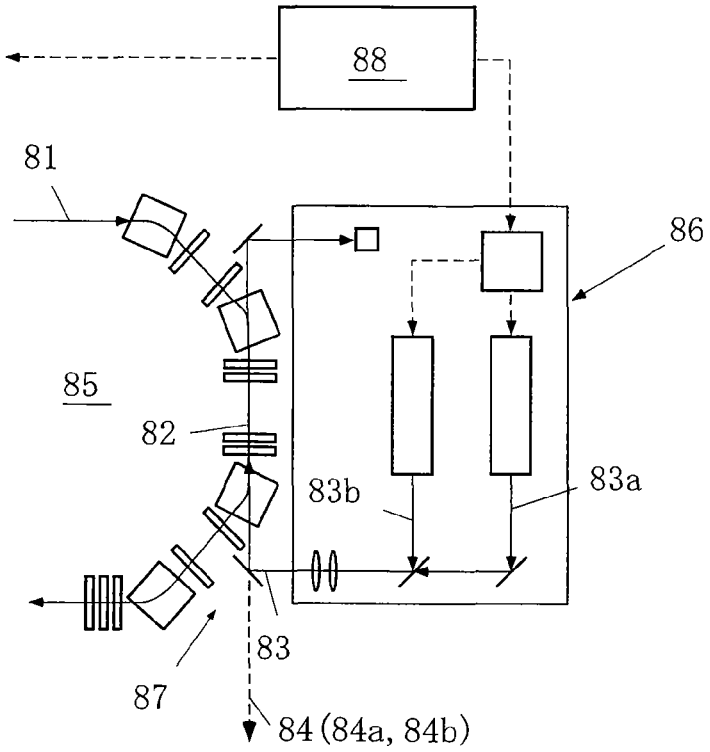
Fig. 4 Prior Art
FIG. 4 is a constitution diagram of "Multi-Color X-Ray Generator" of Patent Document 3.

A preferable embodiment of the present invention will hereinafter be described with reference to the drawings. It is to be noted that, in the drawings, common parts are denoted by the same reference numerals, and redundant description thereof is omitted.

Figure 5:
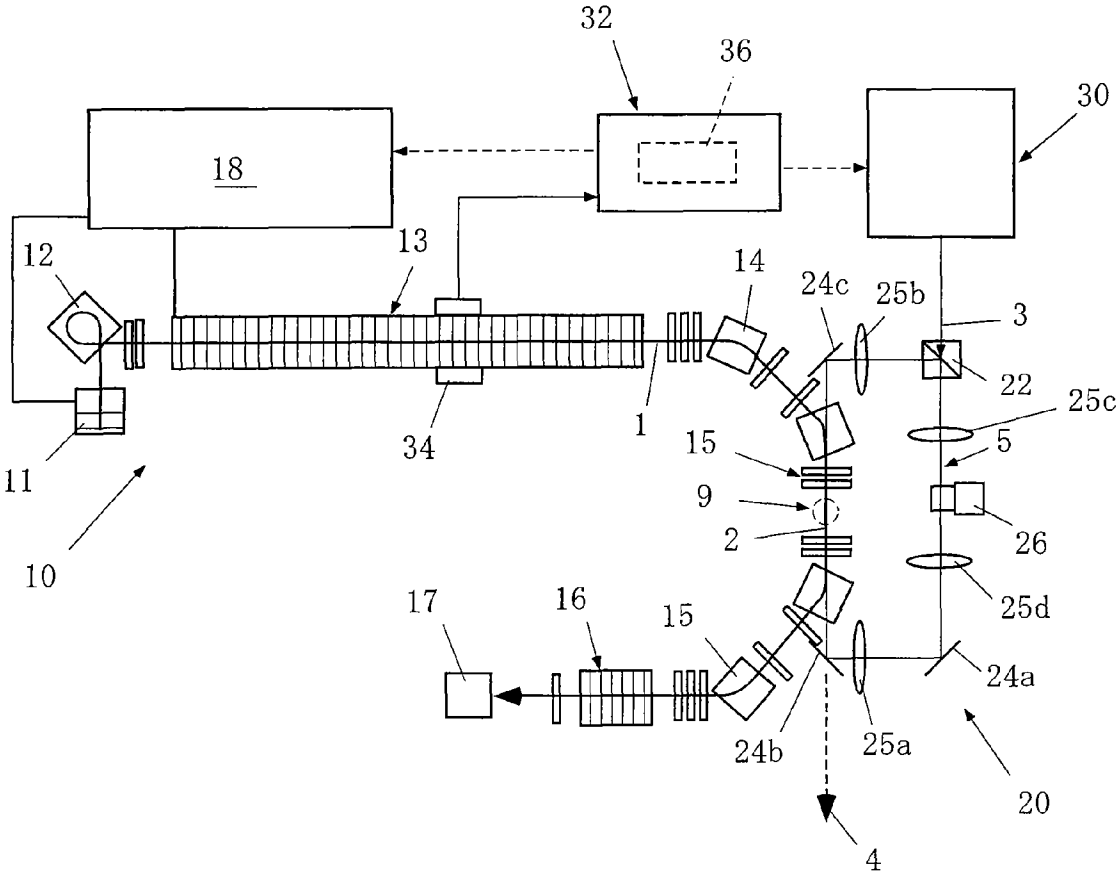
FIG. 5 is the whole constitution diagram of an X-ray generator having a collision-timing adjusting device according to the present invention.

FIG. 5 is the whole constitution diagram of an X-ray generator having a collision-timing adjusting device according to the present invention. The X-ray generator includes a pulse electron beam generator 10, a laser light circulator 20, and a laser generator 30, and is a device that generates an X-ray 4 by inverse Compton scattering by head-on colliding an electron beam 1 with pulse laser light 3.

The electron beam generator 10 has a function of generating the pulse electron beam 1 by accelerating an electron beam and passing the electron beam through a predetermined rectilinear orbit 2.

In this example, the electron beam generator 10 includes an RF electron gun 11, an α-magnet 12, an acceleration tube 13, a bending magnet 14, Q-magnets 15, a deceleration tube 16, and a beam dump 17.

The RF electron gun 11 and the acceleration tube 13 are driven by a high-frequency power source 18 in an X-band (11.424 GHz). An orbit of the electron beam drawn from the RF electron gun 11 is changed by the α-magnet 12, and the beam then enters the acceleration tube 13. The acceleration tube 13 is a small-sized X-band acceleration tube, which accelerates the electron beam to generate a high-energy electron beam of preferably about 50 MeV.

The bending magnet 14 bends the orbit of the pulse electron beam 1 with a magnetic field, passes the beam through the predetermined rectilinear orbit 2, and guides the passed pulse electron beam 1 to the beam dump 17. The Q-magnets 15 regulate a convergence degree of the pulse electron beam 1. The deceleration tube 16 decelerates the pulse electron beam 1. The beam dump 17 traps the pulse electron beam 1 passed through the rectilinear orbit 2 to prevent radiation leakage.

By the electron beam generator 10 described above, the pulse electron beam 1 of, for example, about 50 MeV and about 1 μs can be generated and passed through the predetermined rectilinear orbit 2.

The laser light circulator 20 is adapted to repeatedly pass the pulse laser light 3 through a collision point 9 within a circulation path 5 by introducing the pulse laser light 3 (P-polarized light) from an external laser generator 30 into the circulation path 5 through a polarization beam splitter 22 and confining the pulse laser light 3 within the circulation path 5 for circulating the pulse laser light.

In this figure, the laser light circulator 20 includes the polarization beam splitter 22, a plurality of (in this figure, three) reflection mirrors 24*a*, 24*b*, 24*c*, a plurality of (in this figure, four) lenses 25*a*, 25*b*, 25*c*, 25*d*, a Pockels cell 26, and a control unit (not shown).

The polarization beam splitter 22 directly passes first rectilinear polarization light 3*a* (P-polarized light) and perpendicularly reflects second rectilinear polarization light 3*b* (S-polarized light) orthogonal thereto.

The three reflection mirrors 24*a*, 24*b*, 24*c* constitute the circulation path 5, which circulates the pulse laser light 3 to the polarization beam splitter 22, by reflecting the pulse laser light 3 output from the polarization beam splitter 22 multiple times (three times in this figure).

The Pockels cell 26 is placed at a downstream side of the polarization beam splitter 22 within the circulation path 5 and rotates a polarization direction of polarized light, passing therethrough upon voltage application, by 90 degrees. The Pockels cell is non-linear optical crystal capable of quickly switching a polarization direction of a light beam.

The control unit (not shown) controls the Pockels cell 26 so that the pulse laser light 3 constantly becomes the second rectilinear polarized light 3*b* (S-polarized light) circulated and input to the polarization beam splitter 22.

According to the above-described constitution, the laser light circulator 20 confines the pulse laser light 3 within the circulation path 5 for circulating the pulse laser light and repeatedly passes the pulse laser light 3 through the collision point 9 within the circulation path, thereby increasing a collision rate between an electron beam and laser light and increasing an X-ray generation output.

In the present invention, the above-described laser light circulator 20 is not essential. This may be omitted and the pulse laser light 3 may be used in a once-through way.

A collision-timing adjusting device 32 of the present invention has a function of head-on colliding the pulse laser light 3 with the pulse electron beam 1 at the collision point 9 on the predetermined rectilinear orbit 2 by acquiring synchronization between the electron beam generator 10 and the laser generator 30 and controlling the timing of generating the pulse electron beam 1 and the timing of generating the pulse laser light 3.

Figure 6:
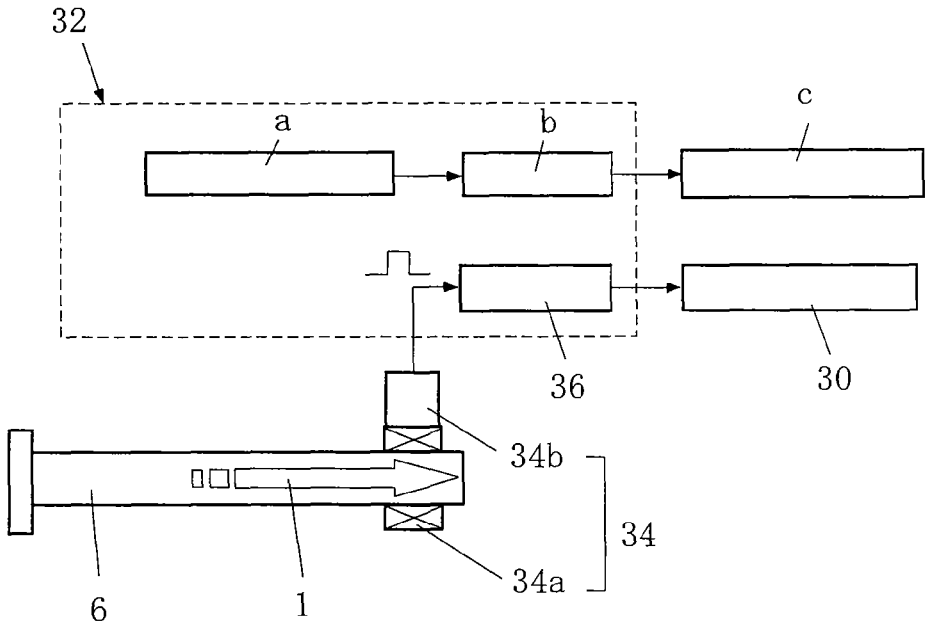
FIG. 6 is the whole constitution diagram of the collision-timing adjusting device according to the present invention.

FIG. 6 is the whole constitution diagram of the collision-timing adjusting device according to the present invention.

In FIG. 5, the laser generator 30 is a pulse laser generator, which oscillates and emits the pulse laser light 3 in response to a laser light generation command signal from the collision-timing adjusting device 32. The laser light may be emitted by a Q-switch.

A predicted collision point 9*a* is preset on the common rectilinear orbit 2 (the optical path) of the laser light 3 and the electron beam 1. The lens 25*a* installed on the optical path of the pulse laser light 3 is set so that the pulse laser light 3 is concentrated to have a minimum light-focusing diameter at the predicted collision point 9*a* as the focus. It is preferable to make the minimum light-focusing diameter as narrow as possible in order to increase a probability of colliding with the electron beam. For example, an optical system of a laser is designed so that the minimum light-focusing diameter becomes 1 μm or less.

As illustrated in FIGS. 5 and 6, the collision-timing adjusting device 32 includes an electron beam detector 34 and a laser light command delay circuit 36.

The electron beam detector 34 provided on a passing path of the electron beam 1 has a function of detecting passing therethrough without affecting the electron beam 1.

In this example, the electron beam detector 34 has a conductive coil 34*a* and a current detector 34*b*. The conductive coil 34*a* is provided on an outer side of a duct through which the electron beam 1 is passed and surrounds a path of the electron beam 1. The current detector 34*b* measures an induced current occurring in the conductive coil 34*a* and outputs a detection signal when the measured current exceeds a predetermined threshold.

Figure 7:
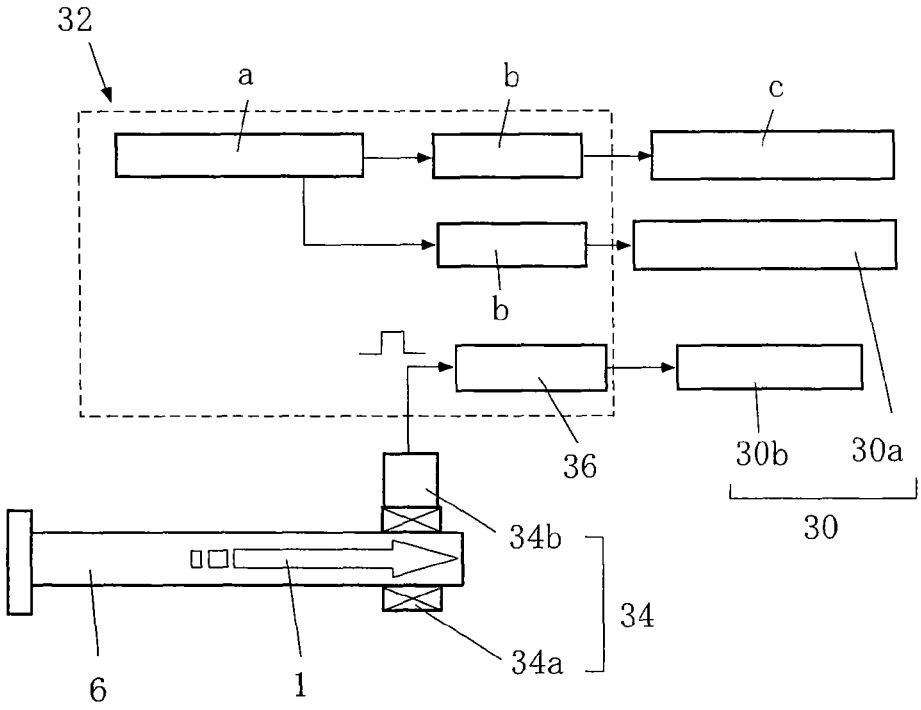
FIG. 7 is a specific example of the collision-timing adjusting device according to the present invention.

FIG. 7 is a specific example of the collision-timing adjusting device according to the present invention. In this example, the laser generator 30 has a flash lamp 30*a* for exciting the laser light 3 and a Q-switch 30*b*, and emits the pulse laser light 3 by the Q-switch 30*b* in response to the laser light generation command signal from the collision-timing adjusting device 32.

That is, the laser generator 30, which generates the laser light 3, is a Q-switched pulse laser and adjusts the timing of the Q-switch by the detection of the current detector 34*b*.

In the above-described constitution, it is assumed that a time from a moment when the collision-timing adjusting device 32 outputs a laser light generation command signal to a moment when the pulse laser light 3 is generated and reaches the predicted collision point 9*a* is "laser delay time $t_L$," in this application.

A delay time from a moment when the Q-switch 30*b* operates to a moment when the pulse laser light 3 is emitted is stable and very short (e.g., several ns or less). An optical path length of the laser light 3 does not substantially change and may be measured or calculated in advance with high precision. Accordingly, the laser delay time $t_L$ does not substantially change and may be produced in advance with high precision.

It is assumed that a time from a moment when the above-described electron beam detector 34 detects passing of the electron beam 1 to a moment when the electron beam 1 reaches the collision point 9*a* is "beam delay time $t_B$" in this application.

In the present invention, an installation position of the electron beam detector 34 is set so that the beam delay time $t_B$ is longer than the laser delay time $t_L$ by at least the delay time Δt described later. This set position is preferably at a downstream side of the accelerator, and is set to a position close to the predicted collision point 9*a* as long as the above-described conditions are satisfied.

A time (i.e., beam delay time $t_B$) when the electron beam 1 reaches the predicted collision point 9*a* after passing through a detection position by the electron beam detector 34 does not substantially change and may be easily and exactly calculated since the speed of the electron beam 1 substantially reaches the light speed at the installation position.

In the present invention, the laser light command delay circuit 36 outputs the generation command for the laser light 3 when a predetermined delay time Δt has elapsed after detecting the passing of the electron beam 1 by the electron beam detector 34. It is preferred that the setting of the delay time Δt by the laser light command delay circuit 36 be variably adjusted with a high precision of 0.1 ns or less.

Figure 8:
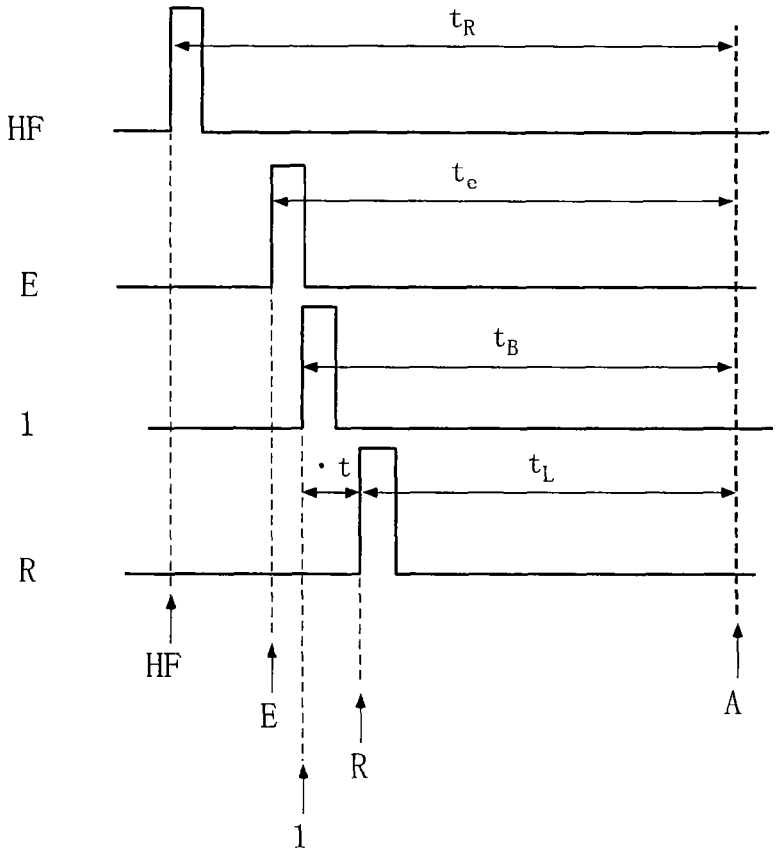
FIG. 8 is a schematic diagram of a collision-timing adjusting method of the present invention.
Figure 9:
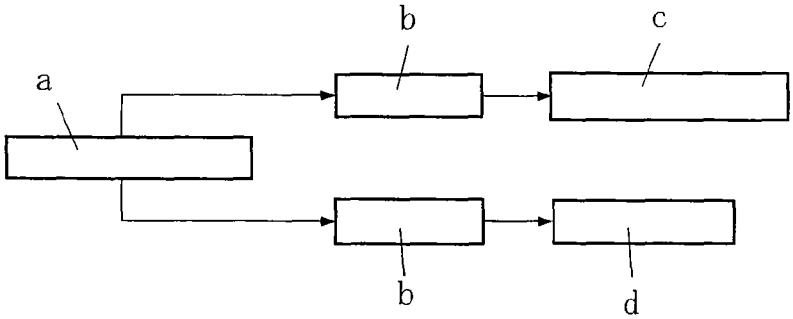
FIG. 9 is a schematic diagram of a conventional collision-timing adjusting device.
Figure 10:
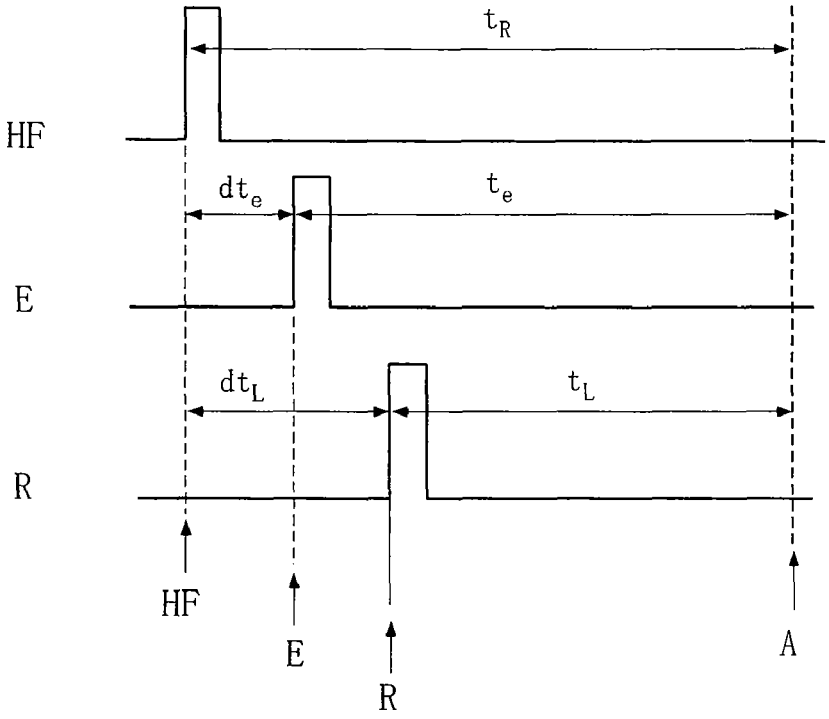
FIG. 10 is a schematic diagram of a conventional collision-timing adjusting method.
Figure 11:
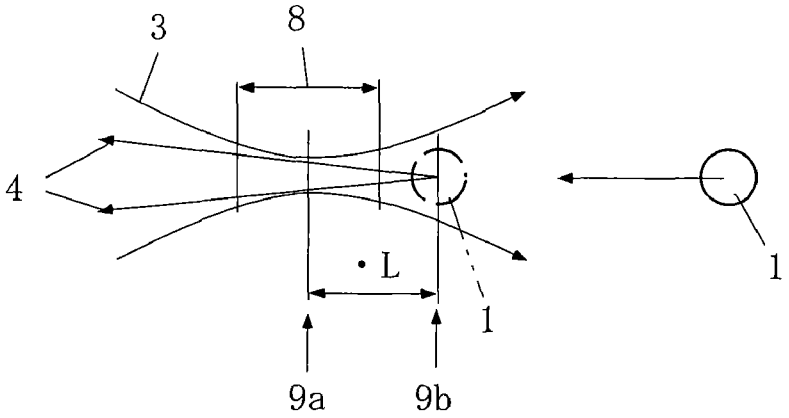
FIG. 11 is a diagram schematically illustrating a collision situation between an electron beam and laser light.

FIG. 8 is a schematic diagram of a collision-timing adjusting method of the present invention. In this figure, the horizontal axis represents the time, $t_R$ represents a time ("high-frequency delay time") from a high-frequency generation moment to a moment when an electron beam reaches a collision point, $t_e$ represents a time ("electron delay time") from an electron generation moment to the moment when the electron beam reaches the collision point, and $t_L$ represents a time ("laser delay time") from a laser oscillation moment to the moment when the laser light reaches the collision point.

Also, $t_B$ represents a time (beam delay time) from a moment when the electron beam detector 34 detects the passing of the electron beam 1 to a moment when the electron beam 1 reaches the predicted collision point 9*a*, and Δt represents a delay time from a moment when the laser light command delay circuit 36 detects the passing of the electron beam 1 to the laser oscillation moment.

In FIG. 8, in the collision-timing adjusting method of the present invention, as a first step, the installation position is set on the passing path of the electron beam 1 so that the beam delay time $t_B$ from the passing moment of the electron beam 1 to the moment when the electron beam 1 reaches the predicted collision point 9*a* is longer than the laser delay time $t_L$ from a moment when a command for generating the laser light 3 is issued to the moment when the laser light reaches the predicted collision point 9*a* by the predetermined delay time Δt.

Then, as a second step, the electron beam detector 34 detects the passing of the electron beam 1 at the set position without affecting the electron beam 1.

Then, as a third step, a command for generating the laser light 3 is output when the predetermined delay time Δt ($=t_B-t_L$) has elapsed after detecting the passing of the electron beam 1.

In the method of the present invention, the conductive coil 34*a* is provided on an outer side of a vacuum chamber through which the electron beam is passed and surrounds an electron beam path. An induced current occurring in the coil 34*a* is measured by the current detector 34*b* and the passing of the electron beam 1 is detected without affecting the electron beam 1.

As described above, the laser delay time $t_L$ does not substantially change and may be produced in advance with high precision. The beam delay time $t_B$ does not substantially change and may be easily and exactly calculated since the speed of the electron beam 1 substantially reaches the light speed at the installation position. The laser light command delay circuit 36 may variably adjust the difference $\Delta t$ between the beam delay time $t_B$ and the laser delay time $t_L$ with a high precision of 0.1 ns or less.

According to a state of the high-frequency generator or electron generator (electron gun), the beam delay time $t_B$, the laser delay time $t_L$, and the difference (delay time) $\Delta t$ therebetween may be produced in advance with high precision substantially without a change even when the timing of generating an electron or an electron beam fluctuates (changes).

Accordingly, the device and method of the present invention may minimize the fluctuation (change) of the beam delay time $t_B$ from a moment when the electron beam 1 is passed through a detection position to a moment when the electron beam reaches the predicted collision point 9*a* even in a case where the timing of generating an electron or an electron beam changes in a generation command. As a result, a collision section area of the electron beam 1 and the laser light 3 may be substantially uniform, so that the temporal fluctuation in an intensity of generated X-rays may be minimized and an X-ray generation output may be increased. Since a virtual focus (generation point) of an X-ray does not change, an X-ray image may be captured with higher precision.

It is to be noted that the present invention is not limited to the above embodiments, and needless to say, the present invention can variously be modified without departing from the scope of the present invention.

The invention claimed is:

1. A device for adjusting collision timing between an electron beam and laser light in an X-ray generator that generates an X-ray by inverse Compton scattering by colliding the electron beam with the laser light, the device comprising:

an electron beam detector arranged on a passing path of an electron beam, wherein the electron beam detector detects the electron beam passing therethrough without affecting the electron beam; and a laser light command delay circuit that outputs a laser light generation command when a predetermined delay time has elapsed after detecting the passing of the electron beam, wherein an installation position of the electron beam detector is set so that a beam delay time from an electron beam passing moment to a moment when the electron beam reaches a predicted collision point is longer than a laser delay time from a moment when the laser light generation command is issued to a moment when the laser light reaches the predicted collision point by at least the delay time.

2. The collision-timing adjusting device according to claim 1, wherein the electron beam detector has a conductive coil which is provided on an outer side of a duct through which the electron beam is passed and surrounds an electron beam path and a current detector which measures an induced current occurring in the coil.

3. The collision-timing adjusting device according to claim 2, wherein a laser generator for generating the laser light is a Q-switched pulse laser and adjusts timing of a Q-switch by detection of the current detector.

4. A method for adjusting collision timing between an electron beam and laser light in an X-ray generator which generates an X-ray by inverse Compton scattering by colliding the electron beam with the laser light, the method comprising:

setting an installation position on a passing path of an electron beam so that a beam delay time from an electron beam passing moment to a moment when the electron beam reaches a predicted collision point is longer than a laser delay time from a moment when a laser light generation command is issued to a moment when the laser light reaches the predicted collision point by at least the predetermined delay time;

detecting passing of the electron beam at the set position without affecting the electron beam; and outputting the laser light generation command when the predetermined delay time has elapsed after detecting the passing of the electron beam.

5. The collision-timing adjusting method according to claim 4, wherein a conductive coil surrounding an electron beam path is provided on an outer side of a duct through which the electron beam is passed, and the passing of the electron beam is detected by measuring an induced current occurring in the coil without affecting the electron beam.

* * * * *